US005873481A

United States Patent [19]

Gruhn et al.

[11] Patent Number: 5,873,481

[45] Date of Patent: Feb. 23, 1999

[54] DISPLAY AND DISPENSING DEVICE WITH SECURITY DOOR

[75] Inventors: Ryan B. Gruhn, Atlantic; Scott Williams, Casey, both of Iowa

[73] Assignee: Schafer Systems Inc., Adair, Iowa

[21] Appl. No.: 781,685

[22] Filed: Jan. 10, 1997

[51] Int. Cl.[6] ..... B65D 85/67

[52] U.S. Cl. ..... 220/210; 220/254; 220/259; 220/337; 206/390; 206/409; 70/63; 70/159; 221/151; 221/154; 242/160.4; 242/171; 242/172

[58] Field of Search ..... 202/210, 254, 202/255, 259, 334, 337, 340–343, 908; 206/390, 409, 389; 70/63, 158, 159, DIG. 63, 423, 455; 109/66, 68; 221/151, 154; 242/159, 160.1, 160.4, 170, 171, 172, 913; 232/43.1

[56] References Cited

U.S. PATENT DOCUMENTS

| | | | |
|---|---|---|---|
| 2,038,218 | 4/1936 | Holt | 220/254 X |
| 4,033,476 | 7/1977 | Greenquist | 220/334 |
| 4,349,121 | 9/1982 | Lafferty | 220/341 |
| 4,470,517 | 9/1984 | Carrier | 220/341 |
| 5,100,038 | 3/1992 | Schafer . | |
| 5,244,113 | 9/1993 | Stymiest | 220/254 X |
| 5,287,980 | 2/1994 | Saltz . | |
| 5,533,621 | 7/1996 | Schoal, Jr. | 206/409 |
| 5,606,883 | 3/1997 | Svec | 70/63 X |
| 5,680,978 | 10/1997 | Pinion | 220/254 X |
| 5,683,030 | 11/1997 | Moore et al. | 232/43.1 |
| 5,772,061 | 6/1998 | Lowe | 220/908 X |

*Primary Examiner*—Stephen K. Cronin
*Assistant Examiner*—Nathan Newhouse
*Attorney, Agent, or Firm*—G. Brian Pingel

[57] ABSTRACT

A hinged access display and dispensing device for lottery-type tickets includes a housing of box-like configuration with a main door that is pivotally attached to the housing. A lock having a swing arm is secured to the main door. A slot is provided in the housing to coact with the swing arm when the main door is in the closed position to allow the main door to be locked relative to the housing. A horizontal opening is provided in the main door to allow access to tickets placed in the housing. A security door is pivotally attached to the main door to prevent removal of tickets through the horizontal opening. The security door is provided with a lip having a slot so that the swing arm may secure both the main door and the security door relative to the housing.

18 Claims, 6 Drawing Sheets

DISPLAY AND DISPENSING DEVICE WITH SECURITY DOOR

BACKGROUND OF THE INVENTION

1. Field of the Invention

The present invention relates in general to a structure for the display and dispensing of tickets such as lottery tickets. More particularly, this invention relates to a device having a main door pivotally attached to a housing and a security door pivotally connected to the main door to prevent access to the interior of the housing through an opening in the main door.

2. Description of the Prior Art

The use of box-like dispensers for displaying and dispensing of tickets has been known for some time. Generally, such dispensers have common characteristics such as transparent walls through which a stack of tickets may be seen, means for securing the dispensers in position, and an opening through which the tickets may be manually dispensed.

Ticket dispensers are also known in the art to include the opening in a hinged rear door. A lock is typically provided on the door to secure the door in place. Although the door may be locked, however, the lock does not prevent unauthorized removal of tickets through the opening in the door. It would, therefore, be desirable to provide means for securing tickets contained within the ticket dispenser against unauthorized removal through the opening. It would also be desirable that such means not hinder access to the door lock, and that such means not involve a substantial cost or substantial amount of hardware.

The difficulties encountered in the prior art hereinabove are substantially eliminated by the present invention.

SUMMARY OF THE INVENTION

The present invention provides a hinged access display and dispensing device for lottery-type tickets or the like. The display and dispensing device includes a housing of box-like configuration having a floor, a roof, a pair of sidewalls, a front end and an open rear end. A main door is pivotally attached to the housing and is provided with an opening. A security door is secured to pivot from a first position substantially covering the opening of the main door to a second position not covering the opening. Means are also provided for locking the security door.

In the preferred embodiment, the security door is provided with a slot of a sufficient size to accommodate a swing arm which forms part of the locking means. The first position of the security door aligns the slot of the security door with a slot provided in the roof of the housing. This alignment allows the swing arm to pass into both slots simultaneously, to lock both the main door and the security door against unauthorized opening. The second position of the security door uncovers a ticket opening in the main door to allow access to tickets provided within the housing. The security door is preferably molded of a one-piece construction with a knuckle which snaps into pivotal engagement with a pintle molded into the main door. The security door is also preferably provided with an opening to allow access to the lock, even when the security door is in the first position.

DETAILED DESCRIPTION OF THE PREFERRED EMBODIMENT

Figure 1:
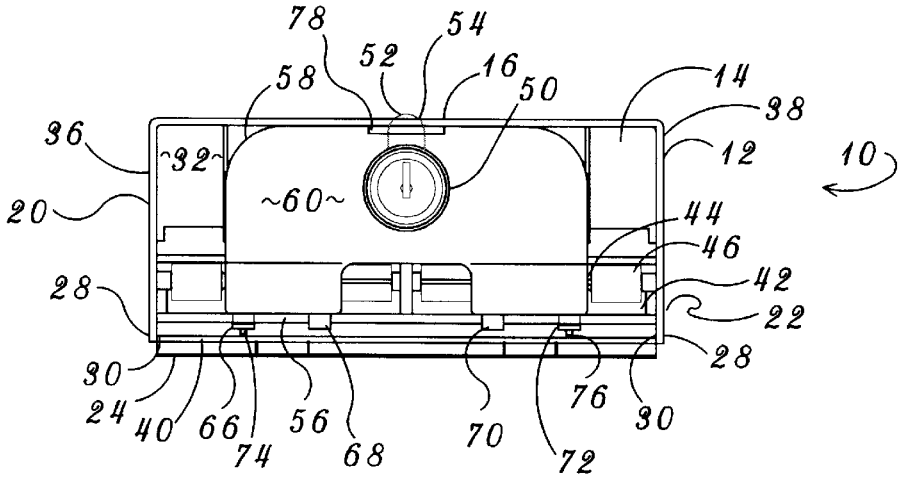
FIG. 1 is a rear elevation showing the main door closed and the security door closed.

With reference to the drawings, a preferred embodiment of a hinged access display and dispensing device of this invention is indicated generally at 10 in FIG. 1. Preferably the device 10 is utilized for displaying and dispensing lottery-type tickets (not shown) on the counters of various types of retail establishments, such as convenience stores (not shown), that sell such tickets.

Figure 2:
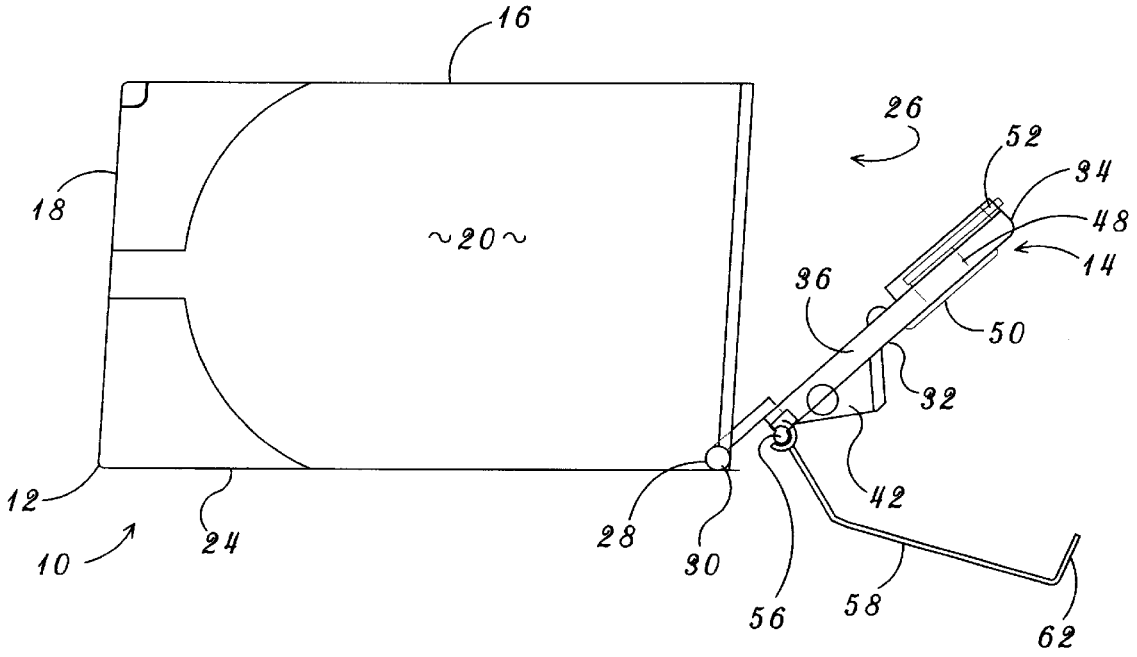
FIG. 2 is a side elevation of the dispensing device of FIG. 1, showing the main door and the security door open.
Figure 4:
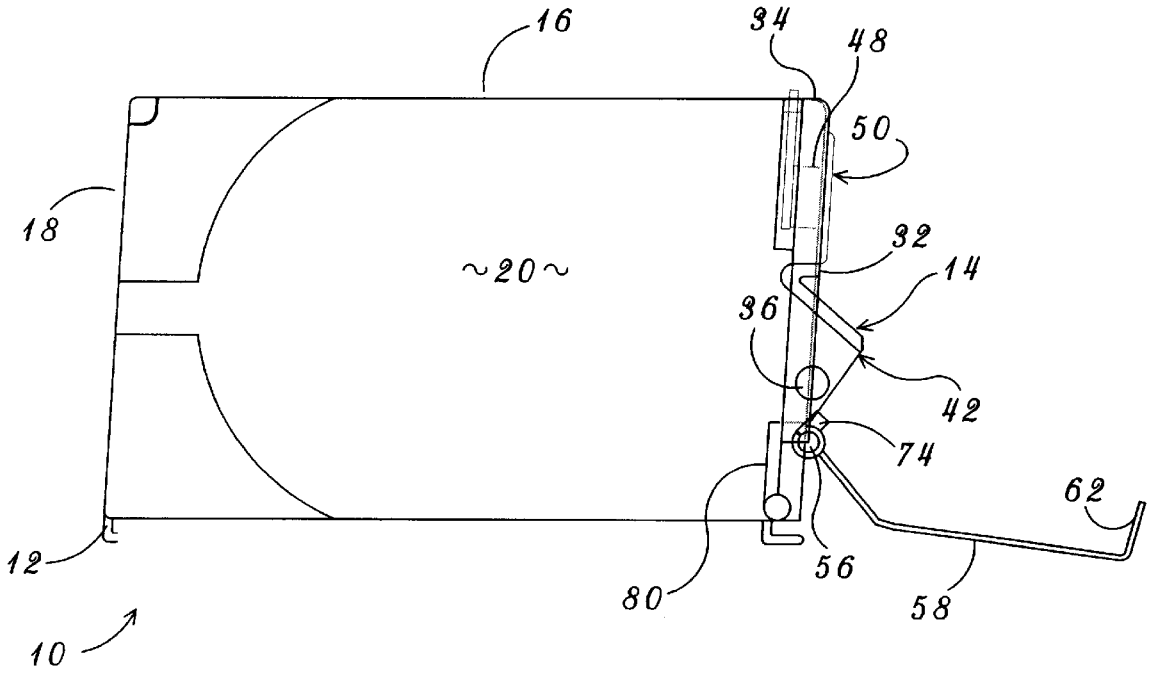
FIG. 4 is a side elevation of the dispensing device of FIG. 1, showing the main door closed and the security door open.

The device 10 includes a transparent, box-shaped housing 12 and a main door 14. The housing has a generally flat roof 16, a front wall 18, a pair of opposite sidewalls 20 and 22, a bottom surface 24, and an open rear end 26 (FIGS. 1–2). The open rear end 26 allows access to the inside of the housing 12 when the main door 14 is opened. Formed in the bottom rear corner of the sidewalls 20 and 22 are holes 28. The main door 14, as best shown in FIGS. 1 and 2, has a vertical face 32, a horizontal top flange 34 and a pair of vertical side flanges 36 and 38,. A bottom edge 40 of the main door 14 is generally cylindrical in shape and has a pair of stub shafts 30 at opposite ends. The stub shafts 30 are designed to be receivably journaled in the holes 28 of the housing sidewalls 20 and 22. When the main door 14 is in the closed position, as best shown in FIGS. 1 and 4, the horizontal top flange 34 and the vertical side flanges 36 and 38 of the main door 14 encompass and provide a close fit with the housing 12.

The vertical door face 32 is formed with a horizontal opening 42 that extends almost the full width of the main door 14 and is provided at each end with a pair slotted posts 44 for receiving rollers 46. Also provided in the vertical face 32 of the door 14 is an opening shown generally at 48 for installation of a commercially available key actuated cam lock assembly 50.

Referring now to FIG. 1, the lock assembly 50 includes a swing arm 52. When the main door 14 is closed, as best shown in FIGS. 1 and 6, the lock assembly 50 can be actuated by a key (not shown) to cause rotation of the arm 52 so that the arm 52 engages a slot 54 in the roof 16 of the housing 12 to secure the main door 14 to the housing 12.

Figure 7:
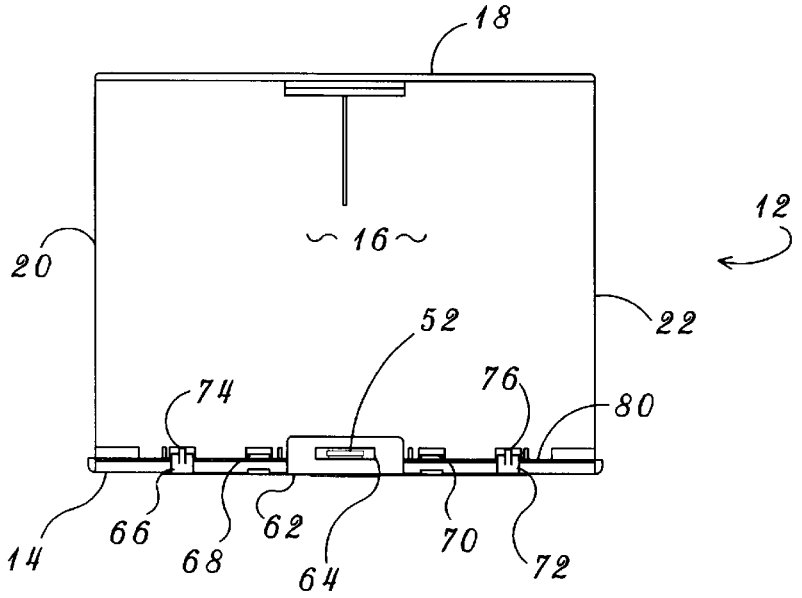
FIG. 7 is a top plan view of the display and dispensing device of FIG. 1, shown with the security door closed.
Figure 3:
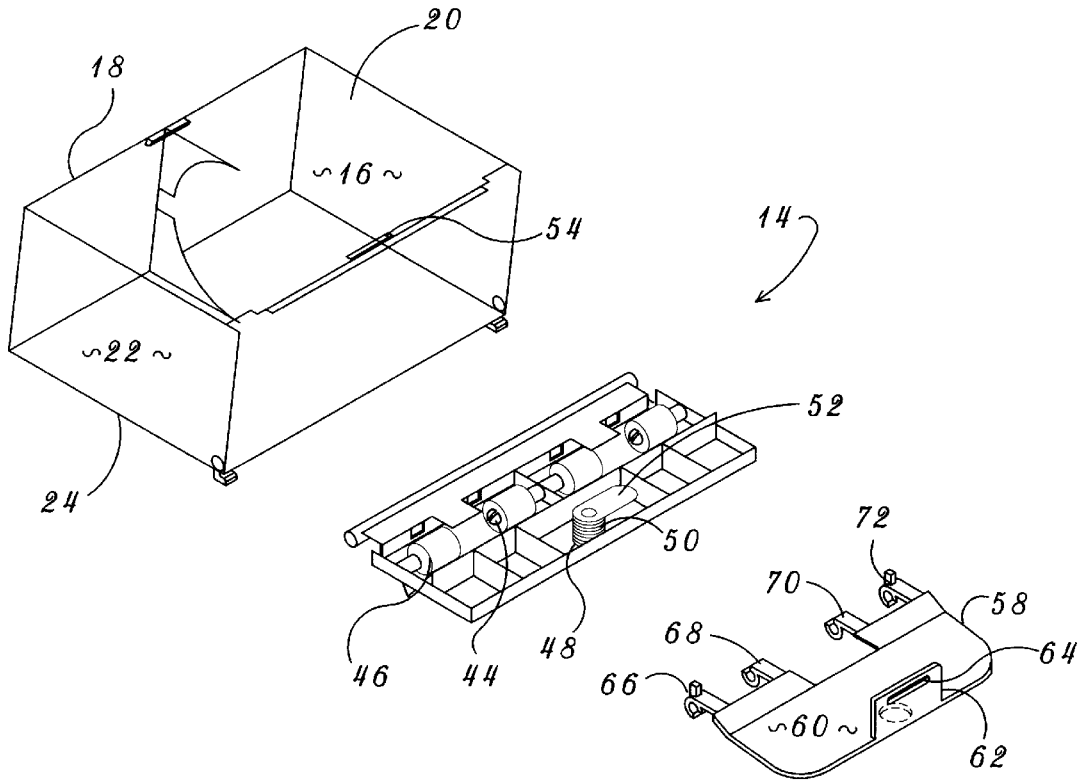
FIG. 3 is an exploded perspective view of the display and dispensing device of the present invention.

Molded into the main door 14 is a cylindrical pintle 56. A security door 58 is hingably coupled to the pintle 56 to cover the horizontal opening 42 in the display and dispensing device 10. As shown in FIGS. 1, 3 and 7, the security door 58 is provided with a vertical face 60, a top lip 62 having a slot 64 and a plurality of knuckles 66, 68, 70 and 72, all preferably integrally molded as a portion of the one-piece security door 58. Additionally, as shown in FIG. 6, the security door 58 is provided with a key hole 73 to provide access to the lock assembly 50 when the security door 58 is closed.

Figure 6:
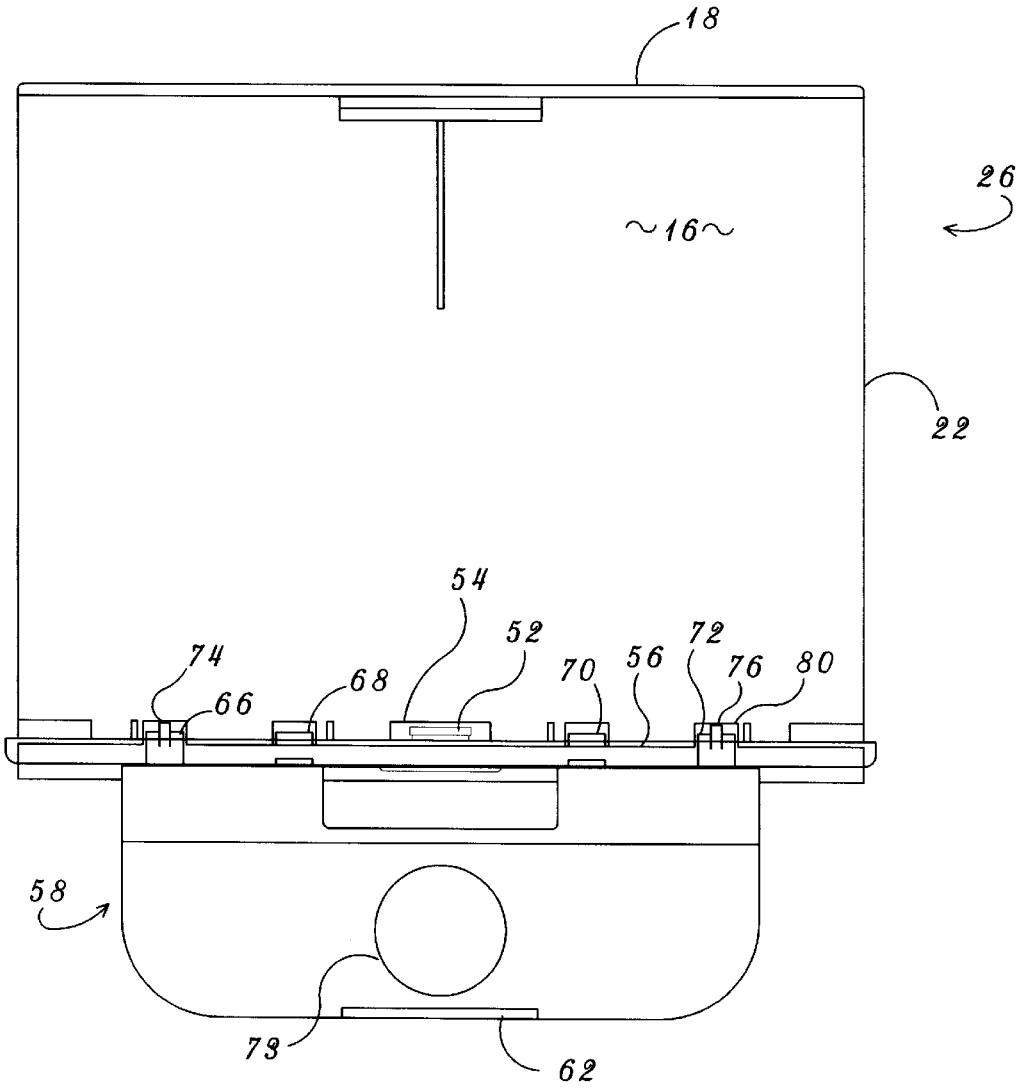
FIG. 6 is a top plan view of the dispensing device of FIG. 1, showing the main door closed and the security door open.

As shown in FIGS. 3 and 6, the outer knuckles 66 and 72 of the security door 58 are curved rearwardly, while the inner knuckles 68 and 70 are curved forwardly. Additionally, the outer knuckles 66 and 72 are provided with flanges 74 and 76 for a purpose to be described below. The security door 58 is preferably molded of a one-piece semi-resilient plastic material to allow the knuckles 66, 68, 70 and 72 to be manually biased to engage the pintle 56 of the main door 14 as shown in FIG. 1. This attachment allows the security door 58 to pivot relative to the main door 14 as shown in FIG. 2.

To operate the display and dispensing device 10, the tickets are provided in the housing 12, and the main door 14 is closed as shown in FIG. 4. The key is used to rotate the lock assembly 50 until the arm 52 passes through a slot 54 provided in the roof 16 of the housing 12. In this manner, the main door 14 is secured relative to the housing 12, while the tickets may still be accessed through the horizontal opening 42 of the main door 14.

Figure 5:
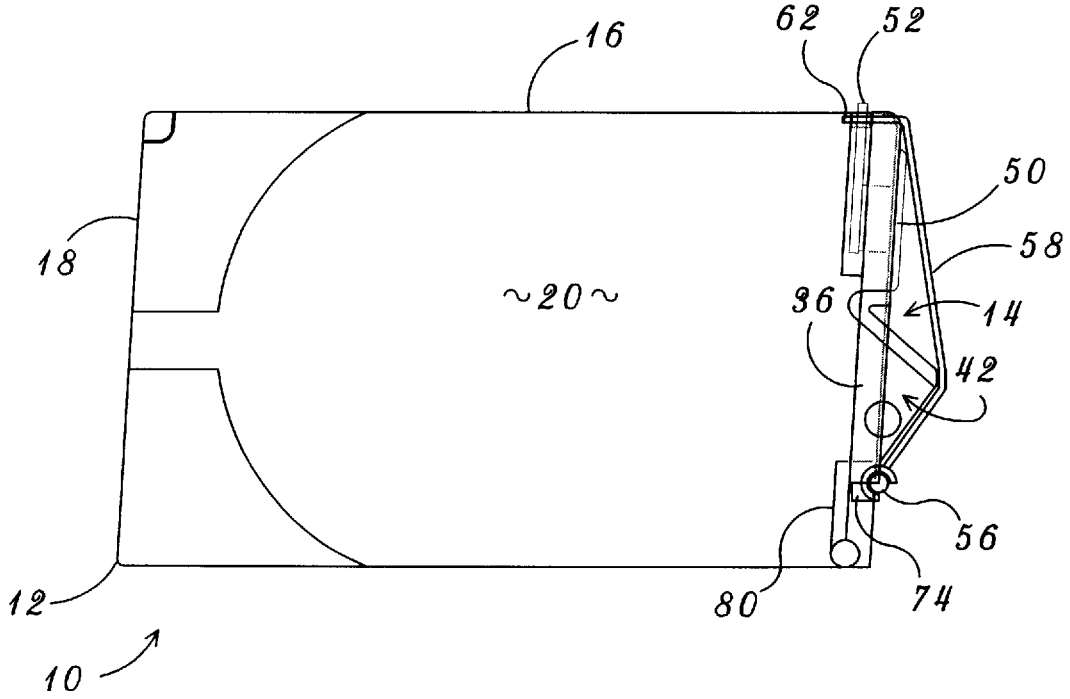
FIG. 5 is a side elevation of the dispensing device of FIG. 1, showing both the main door and the security door closed.

If the display and dispensing device 10 is to be left unattended, the key is used to rotate the lock assembly 50 until the arm 52 moves out of the slot 54. The security door 58 is thereafter pivoted upward until the slot 64 in the lip 62 of the security door 58 passes through a lip slot 78 in the main door 14. The slot 64 in the lip 62 is then aligned with the slot 54 in the roof 16 of the housing 12. The lock assembly 50 is then rotated until the arm 52 passes through both the security door slot 64 and the housing slot 54 as shown in FIG. 5. As shown in FIG. 1, the dimensions of the vertical face 60 of the security door 58 are such that when the security door 58 is latched as shown in FIG. 5, the interior of the housing 12 cannot be accessed through the horizontal opening 42. Therefore, latching the security door prevents unauthorized removal of tickets from the housing 12 when the display and dispensing device 10 is to be left unattended.

Although the resilient nature of the knuckles 66, 68, 70 and 72 allow the security door 58 to be attached to the door 14 manually, the flanges 74 and 76 provided on the outer knuckles 66 and 72 prevent unauthorized removal of the security door 58 from the main door 14 when the security door 58 is latched (FIG. 5). As shown in FIG. 7, the main door 14 is provided with a footing 80 which runs relatively closely to the knuckles 66, 68, 70 and 72. As shown in FIG. 3, the flanges 74 and 76 secured to the knuckles 66 and 72 extend perpendicular to the vertical face 60. Accordingly, when the vertical face 60 is secured as shown in FIG. 5, the flanges 74 and 76 are positioned very closely to the brace 80 of the main door 14. The close proximity of the flanges 74 and 76 to the brace 80 prevents the outer knuckles 66 and 72 from being biased forward relative to the main door. However, when the security door 58 is open, as shown in FIG. 6, the flanges 74 and 76 are directed upward, so that the flanges 74 and 76 are no longer positioned directly behind the brace 80.

When the security door 58 is open as shown in FIG. 6, the flanges 74 and 76 are positioned above the brace 80. Accordingly, when the knuckles outer 66 and 72 are biased forward to be secured around or detached from the pintle 56 of the door 14, the flanges 74 and 76 do not contact the brace 80. The security door 58, therefore, may be attached manually, without the need for special tools. When the security door 58 is latched as shown in FIG. 5, however, the outer knuckles cannot be manipulated. The close proximity of the flanges 74 and 76 to the brace 80 prevent dislocation of the knuckles 66, 68, 70 and 72 from the pintle. Therefore, when the security door 58 is locked, it cannot be removed without damage to the display and dispensing device 10.

Although the invention has been described with respect to a preferred embodiment thereof, it is to be understood that it is not to be so limited, since changes and modifications can be made therein which are within the full intended scope of this invention as defined by the appended claims. For example, it is anticipated that a plurality of security doors may be provided to cover a plurality of vertical openings in a particular main door.

It is additionally anticipated that the lip of the security door need not pass through a slot in the main door. The lip may instead pass over the swing arm slot in the housing to align the slot in the housing with the slot in the lip.

What is claimed is:

1. A hinged access display and dispensing device for tickets comprising:

(a) a housing of box configuration having a floor, a roof, a pair of sidewalls, a front end and an open rear end;

(b) a main door pivotally attached to said housing, said main door having engaging means integrally molded thereto and an opening provided in said main door;

(c) a security door coupled to said engaging means to pivot from a first position substantially covering said opening of said main door to a second position not covering said opening of said main door; and (d) means for locking said main door to said housing, said locking means additionally locking said security door to said main door and said housing.

2. The display and dispensing device of claim 1, wherein said roof is provided with a slot, said security door is provided with a slot and said locking means is provided with a swing arm of a size sufficient to fit into said slot of said roof and said slot of said security door.

3. The display and dispensing device of claim 1, wherein said security door is provided with a hole.

4. The display and dispensing device of claim 1, further comprising attachment means provided on said security door for allowing releasable attachment of said security door to said enagaging means.

5. The display and dispensing device of claim 4, wherein said attachment means is a knuckle.

6. The display and dispensing device of claim 5, further comprising means for preventing removal of said knuckle from said engaging means when said security door is in said first position.

7. The display and dispensing device of claim 6, wherein said preventing means is a flange of a sufficient length so as to provide insufficient room between said flange and a portion of said door to allow removal of said knuckle from said pintle when said security door is in said first position.

8. The display and dispensing device of claim 1, wherein said engaging means is a pintle and wherein said security door is provided with a knuckle cupped around said pintle.

9. The display and dispensing device of claim 8, wherein said knuckle and said security door are sufficiently resilient to allow said knuckle to be manually deflected a sufficient distance to secure said knuckle in said cupping orientation around said pintle.

10. The display and dispensing device of claim 9, wherein said door and said pintle are integrally molded into a single piece of plastic.

11. The display and dispensing device of claim 10, further comprising means provided on said knuckle for preventing removal of said knuckle from said pintle when said security door is in said first position.

12. The display and dispensing device of claim 11, wherein said preventing means is a flange of a sufficient length so as to provide insufficient room between said flange and a portion of said main door to allow removal of said knuckle from said pintle when said security door is in said first position.

13. The display and dispensing device of claim 12, wherein said security door, said knuckle and said flange are all integrally molded into a single piece of plastic.

14. A hinged access display and dispensing device for tickets comprising:

(a) a housing of box configuration having a floor, a roof provided with a slot, a pair of sidewalls, a front end and an open rear end;

(b) a main door having an opening and a pintle integrally molded therto, said main door being pivotally attached to said housing;

(c) a security door having a slot and a knuckle, said knuckle being pivotally engaged around said pintle in a manner which allows said security door to pivot from a first position covering said opening and aligning said security door slot with said housing slot and a second position not covering said opening; and (d) a lock having a swing arm, said lock secured to said main door in a manner which allows said swing arm to pivot between a first position wherein said swing arm passes into said slot of said security door and into said slot of said housing to a second position wherein said swing arm is not located within said slot of said housing and is not located within said slot of said security door.

15. The display and dispensing device of claim 14, further comprising means for preventing removal of said knuckle from said pintle when said security door is in said first position and for allowing removal of said knuckle from said pintle when said security door is in said second position.

16. The display and dispensing device of claim 15, wherein said preventing means is a flange secured to said knuckle.

17. The display and dispensing device of claim 16, wherein said flange is of a sufficient length so as to provide insufficient room between said flange and a portion of said main door to allow removal of said knuckle from said pintle when said security door is in said first position and of a sufficient orientation relative to said knuckle and said main door so as to provide sufficient room between said flange and said main door to allow removal of said knuckle from said pintle when said security door is in said second position.

18. The display and dispensing device of claim 17, wherein said security door, said knuckle and said flange are all integrally molded into a single piece of plastic.

* * * * *